US006409638B1

(12) United States Patent
Huston

(10) Patent No.: US 6,409,638 B1
(45) Date of Patent: Jun. 25, 2002

(54) STOMACH AND MID-TORSO MUSCLE TONING DEVICE

(76) Inventor: Trevor Lee Huston, 452 Longwood Dr., Venice, FL (US) 34292

( * ) Notice: Subject to any disclaimer, the term of this patent is extended or adjusted under 35 U.S.C. 154(b) by 0 days.

(21) Appl. No.: 09/779,678

(22) Filed: Feb. 8, 2001

(51) Int. Cl.[7] ..... A63B 23/00
(52) U.S. Cl. ..... 482/112; 482/13
(58) Field of Search ..... 482/13, 4, 148, 482/111, 112, 113; 128/204.18; 434/262

(56) References Cited

U.S. PATENT DOCUMENTS 4,595,196 A * 6/1986 Muchisky et al. ..... 482/13
4,666,148 A * 5/1987 Crawford ..... 482/11
5,738,089 A * 4/1998 Hoshi et al. ..... 128/204.18
6,042,509 A * 3/2000 Wu et al. ..... 482/13

* cited by examiner

*Primary Examiner*—Stephen R. Crow
(74) *Attorney, Agent, or Firm*—Charles J. Prescott

(57) ABSTRACT

A stomach and mid-torso muscle-toning device. The device includes an elongated generally flat, waist-encircling flexible member having end portions and inner and outer panels attached together along common margins therebetween to define a closed or closable central pouch. The waist-encircling member is sized in length to transversely encircle a mid-torso and stomach of a user so that the end portions meet or overlap one another when the member is in an in-use position around the user's torso. Preferably, a releasable two-part hook and loop attachment between the end portions holds the waist member snugly in the in-use position. An elongated inflatable bladder is disposed between the inner and outer panels. An air pump and outlet valve are operably connected to an inlet and outlet, respectively, of the bladder, whereby the bladder may be selectively pressurized. The outer panel and the end portions are substantially non-extensible, while the inner panel is somewhat expandable whereby, when the bladder is pressurized, increased static force is applied inwardly against the torso and the stomach.

3 Claims, 2 Drawing Sheets

STOMACH AND MID-TORSO MUSCLE TONING DEVICE

BACKGROUND OF THE INVENTION

1. Scope of Invention

This invention relates generally to therapeutic waist belts and other devices which encircle and support the mid-torso of a user, and more particularly to a device which encircles the mid-torso and stomach and applies inward pressure against the stomach on a controlled and limited basis for toning stomach muscles.

2. Prior Art

There are all sorts of waistbands and torso-supporting and stabilizing devices which are primarily intended to provide remedial support and stabilization for an injured or weakened back or mid-torso region of a patient. These devices generally transversely encircle the mid-torso of a user and provide additional structure and methods of mechanical attachment and tightening which accomplish the remedial stabilization and pressure application on a selected basis.

We all are aware of the need for exercise in daily life to maintain strength and vigor. However, many do not heed this warning or need and allow themselves to become substantially out of condition accompanied by an enlarged appearance, especially in the mid-torso and stomach region. The sports and exercise device market is filled with devices which are intended to tone the stomach muscles and mid-torso with a need for only a limited amount of strenuous exertion. However, in the end, the rewards of enhanced and slimmer appearance and increased strength are only in proportion to the repeated physical exertion in utilizing such quick-fix devices.

The present invention has as the singular purpose of applying inward pressure on a limited time and pressure basis against the stomach muscles to tone and strengthen them without the need for strenuous exercise. The device thus provides a temporary reduction in the overall girth of the mid-torso and stomach and, if repeated with sufficient frequency, will provide a longer-lasting reduction in the overall stomach size and muscle tone. These benefits are accomplished via a low pressure air-filled bladder which will expand inwardly to compress the stomach and mid-torso muscles.

BRIEF SUMMARY OF THE INVENTION

This invention is directed to a stomach and mid-torso muscle-toning device. The device includes an elongated generally flat, waist-encircling flexible member having end portions and inner and outer panels attached together along common margins therebetween to define a closed or closable central pouch. The waist-encircling member is sized in length to transversely encircle a mid-torso and stomach of a user so that the end portions meet or overlap one another when the member is in an in-use position around the user's torso. A releasable preferably two-part hook and loop attachment between the end portions holds the waist member snugly in the in-use position. An elongated inflatable bladder is disposed between the inner and outer panels. An air pump and outlet valve are operably connected to an inlet and outlet, respectively of the bladder, whereby the bladder may be selectively pressurized. The outer panel and the end portions are substantially non-extensible, while the inner panel is somewhat expandable whereby, when the bladder is pressurized, increased static force is applied inwardly against the torso and the stomach.

It is therefore an object of this invention to provide a stomach toner which is virtually completely passive of user physical exertion in its use and which provides at least a temporary, reduction in the stomach muscles and the mid-torso region of a user.

It is another object of this invention to provide a waist-encircling device which exerts controlled static fluid pressure inwardly against the stomach of a user to at least temporarily provide a slimmer stomach appearance after each use of the device.

It is yet another object of this invention to provide a longer term reduction in the girth of the mid-torso and stomach of a user when the device is used frequently.

In accordance with these and other objects which will become apparent hereinafter, the instant invention will now be described with reference to the accompanying drawings.

DETAILED DESCRIPTION OF THE INVENTION

Figure 1:
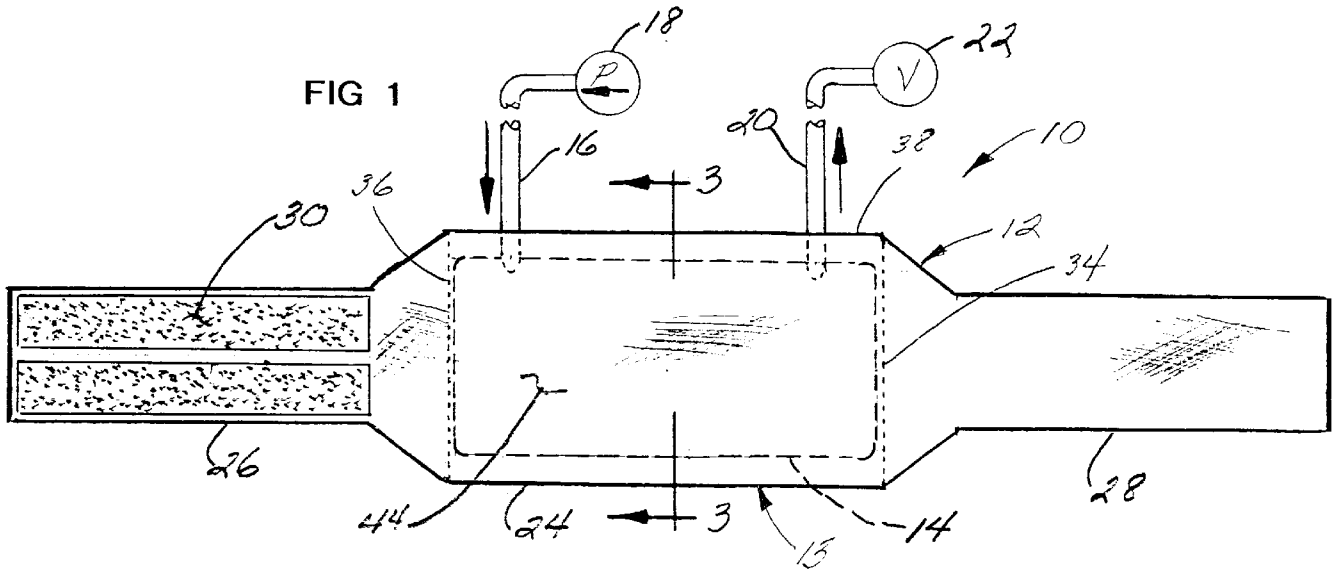
FIG. 1 is a front elevation view of the invention.

Referring now to the drawings, the invention is shown generally at numeral 10 in FIG. 1 and includes a waist encircling member 12 formed substantially of flexible fabric material. Each of the end portions 26 and 28 include mating two-part hook and loop material at 30 and 32, respectively which releasably attach the overlapping end portions together.

The central portion 13 of member 12 is formed of generally coextensive flexible outer and inner panels 44 and 48, respectively, which are connected along common margins 24, 34 and 36 by stitching. Edge margin 38 may be stitched in segments or be releasably connectable to permit the installation and removal of a rubber air bladder 14.

Figure 3:
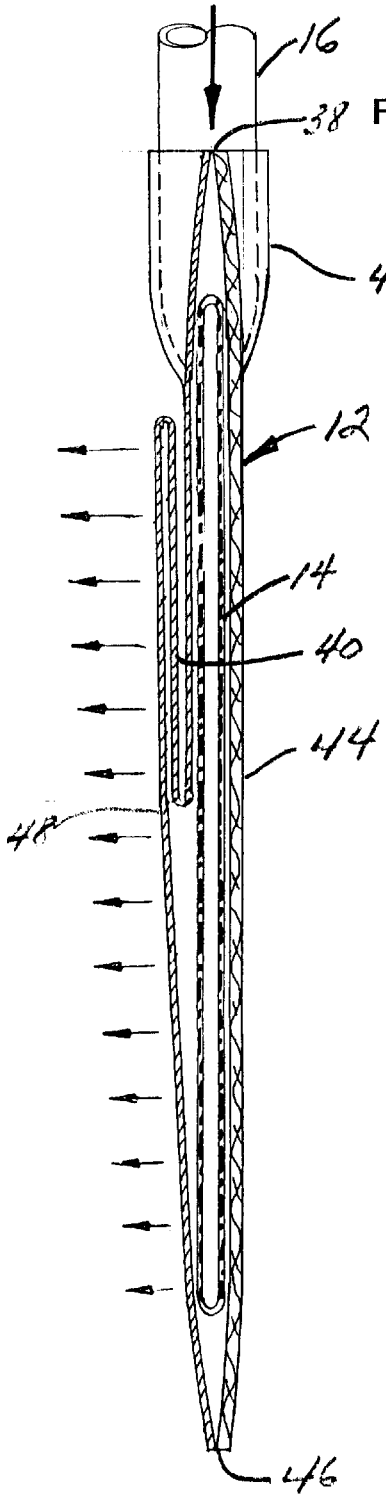
FIG. 3 is a section view in the direction of arrows 3—3 in FIG. 1.

The bladder 14 is formed in a rectangular shape and, as best seen in FIG. 3, is generally flat when uninflated. The bladder 14 is formed of black natural latex rubber having a durometer of 40+/−5 shore A. The preferred latex rubber material also has a minimum elongation of 700% and a tensile strength of approximately 3000 psi; thickness is preferably in the range of 0.04 inches +/−0.005 inches. Operating pressure of the bladder 14 is relatively low and is anticipated to be in the range of up to about 6 psi.

Figure 2:
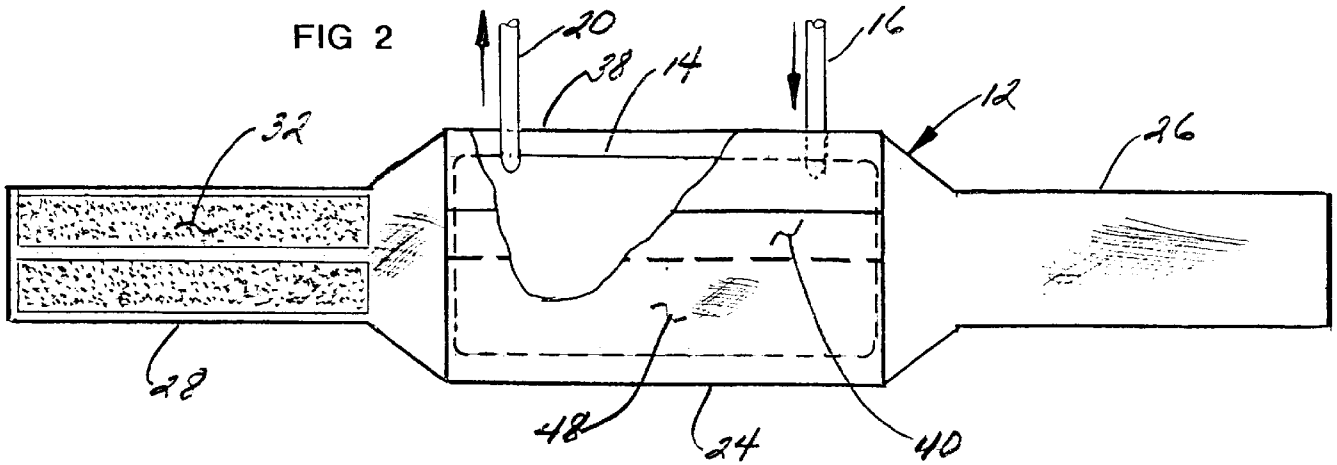
FIG. 2 is a broken rear elevation view of the invention absent pump and control valve.

The bladder 14 is generally rectangular in shape and is overall generally coextensive with a pouch formed between the inner and outer panels 44 and 46, respectively. The outer panel 46 is generally formed of a heavier generally non-extendible canvas-type material as are the end portions 26 and 28. The preferred fabric used for this purpose is heavy canvas duck. However, the inner panel 48 is formed of lighter somewhat stretchable light nylon material having a fold 40 formed lengthwise therein as best seen in FIGS. 2 and 3.

A pump 18 is also provided which is operably connected to a flexible rubber tube 16 which allows pressurized air produced by the pump 18 to flow in the direction of the arrow into the bladder 14. An outlet tube 20 also operably connected to the interior of the bladder 14 is connected to a valve 22 which regulates the outflow of air in the direction of the arrow through outlet tube 20. By this arrangement, the pump 18 will provide pressurized air into the bladder 14 while the valve 22 is manually or automatically regulated as desired to hold a preselected pressure within the bladder 14 and allow the pressurized air to escape on a time cyclic basis as desired.

The pump 18 is preferably a low-pressure and low-airflow volume type. The preferred pump 18 is available from Apollo Enterprises, Inc. of Oxnard Calif., model #APOLLO 7000. This pump is a double diaphragm, single outlet, oscillating linear motion pump which, to date, has proved to be highly effective when used with the prototype of the invention.

Note that this pneumatic embodiment of pump and bladder is preferred, a hydraulic variation using pressurized fluid such as water is envisioned to be within the scope of this invention.

Figure 4:
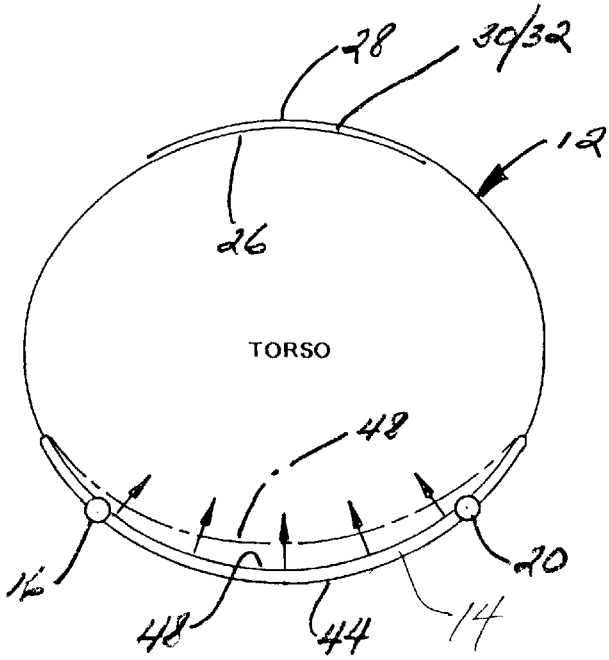
FIG. 4 is a schematic transverse view of a torso of a user with the device shown schematically in position and use.

As best seen in FIGS. 3 and 4, after the user has installed the device 12 around the torso and against the stomach with end portions 26 and 28 overlapping and held in generally snug fitting position by mating two part hook and loop portions 30/32, the pump 18 is activated with the valve 22 in the closed position so that the bladder 14 begins to enlarge. This produces movement of the inner panel 48 inwardly in the direction of the arrows in both FIGS. 3 and 4 due to the fact that the outer panel 44 is substantially non-extensible. Fold 40, in combination with the somewhat more elastic nature of the material selected for panel 48, facilitates the inward movement of the inner panel 48 which effectively reduces the girth or circumference of the device 12, thus compressing primarily the stomach which is typically more resilient and likely to be compressed by this inward force exerted by the bladder 14 as it is inflated. Note that the overlapping and attachment of end portions 26 and 28 are, preferably positioned across the user's lower back so that the enlarged width of the central portion 13 and bladder 14 are positioned directly over the stomach area for maximum effectiveness.

The user may vary the air pressure within the bladder 14 and also regulate the length of time and frequency of bladder pressurization. This cyclic inward pressure against the stomach in a somewhat uniform manner has been shown to effectively and substantially reduce the girth of the stomach for a short period of time, e.g. several hours. Moreover, repeated utilization of the device 10 and frequency of bladder pressurization during each use period will, over time, strengthen and reduce the size of the stomach muscles to, provide a more permanent beneficial effect of strength and girth reduction. To further enhance effectiveness of the device, while static pressure is applied, the user may exert pressure by flexing the stomach muscles.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A stomach and mid-torso muscle exercise and toning device comprising:

an elongated generally flat, flexible member having end portions and inner and outer panels attached together along common margins thereof defining a closed or closable central pouch, said member sized in length to transversely encircle a mid-torso and stomach of a user of said device so that said end portions meet or overlap one another when said member is in an in-use position around the users torso;

a releasable attachment between said end portions to hold said member snugly in the in-use position;

an elongated inflatable bladder having a separate inlet and outlet and being disposed between and generally coextensive with only a central portion of said inner and outer panels;

an air pump and outlet valve operably connected to said inlet and outlet, respectively, whereby said bladder may be selectively pressurized;

said outer panel and said end portions being substantially non-extensible, said inner panel being somewhat expandable whereby, when said bladder is pressurized, increased static force is applied inwardly against the torso and the stomach.

2. A stomach muscle exercise and toning device comprising:

an elongated generally flat, flexible waist encircling member having end portions and inner and outer panels attached together along common margins thereof defining a central pouch therebetween, said waist-encircling member sized in length in an in-use position to transversely encircle a mid-torso and stomach of a user of said device such that said end portions overlap one another;

a releasable attachment between said end portions to hold said member snugly in the in-use position;

an elongated inflatable bladder having an inlet and a separate outlet disposed between said inner and outer panels;

an air pump operably connected to said bladder whereby said bladder may be selectively pressurized;

said outer panel and said end portions being substantially non-extensible, said inner panel being somewhat expandable and including a longitudinal fold generally coextensive with said bladder whereby, when said bladder is pressurized, increased static force is applied inwardly against the torso and the stomach.

3. A stomach and mid-torso muscle exercise and toning device comprising:

an elongated generally flat, flexible waist member having elongated end portions and inner and outer panels attached together along common margins thereof, said inner and outer panels defining a closed or closable central pouch therebetween, said waist member sized in length to transversely encircle a mid-torso and stomach of a user of said device so that said end portions meet or overlap one another when said member is in an in-use position around the user's torso;

a releasable two-part hook and loop attachment between said end portions to hold said overlapping end portions together whereby said waist member is snugly held in the in-use position;

an elongated flat inflatable bladder having an inlet and an outlet separate from said inlet and being disposed between and generally coextensive with only a central portion of said inner and outer panels;

a fluid pump and outlet valve operably connected to an interior of said bladder whereby said bladder may be selectively pressurized;

said outer panel and said end portions being substantially non-extensible, said inner panel having an expandable fold lengthwise of the central portion of said inner panel whereby, when said bladder is pressurized, an inner effective circumference of said waist member is reduced and increased static force is applied inwardly against the torso and the stomach.

* * * * *